US007502661B2

(12) United States Patent
Kojo

(10) Patent No.: US 7,502,661 B2
(45) Date of Patent: Mar. 10, 2009

(54) METHOD FOR CALCULATING AND OPTIMIZING THE DIAMETER OF A PAPER OR BOARD WEB REEL BASED ON CUSTOMER SPLICE LOCATION RESTRICTIONS

(75) Inventor: Teppo Kojo, Mäntsälä (FI)

(73) Assignee: Metso Paper, Inc., Helsinki (FI)

( * ) Notice: Subject to any disclaimer, the term of this patent is extended or adjusted under 35 U.S.C. 154(b) by 465 days.

(21) Appl. No.: 10/554,009

(22) PCT Filed: Apr. 22, 2004

(86) PCT No.: PCT/FI2004/000247

§ 371 (c)(1),
(2), (4) Date: Oct. 21, 2005

(87) PCT Pub. No.: WO2004/094282

PCT Pub. Date: Nov. 4, 2004

(65) Prior Publication Data

US 2006/0243849 A1 Nov. 2, 2006

(30) Foreign Application Priority Data

Apr. 24, 2003 (FI) ..... 20030618

(51) Int. Cl.
*G06F 19/00* (2006.01)
*G06F 7/66* (2006.01)

(52) U.S. Cl. ..... 700/126; 700/127

(58) Field of Classification Search ..... 700/122, 700/126, 127

See application file for complete search history.

(56) References Cited

U.S. PATENT DOCUMENTS 4,077,580 A 3/1978 Lang et al.
4,631,682 A 12/1986 Ng et al.

(Continued)

FOREIGN PATENT DOCUMENTS

WO WO 02/088012 11/2002

(Continued)

OTHER PUBLICATIONS

"Roll Paper Requirements and Specifications" Quebec World Version 1.9, 'Online! Sep. 1, 2003, XP002289964.

(Continued)

*Primary Examiner*—Ryan A Jarrett
(74) *Attorney, Agent, or Firm*—Stiennon & Stiennon

(57) ABSTRACT

A web is wound in a paper or board machine into machine reels, which are run on a slitter-winder to form customer rolls, whose desired diameter and width are determined according to customer need. A continuous-trimming running mode is used in which a desired amount of web is run into a machine reel and, when needed, splicing is performed on the slitter-winder to produce customer rolls with a desired diameter size. The machine reel diameter is determined based on restrictions set on the location of a splice in the customer roll and the amount of broke produced from the machine reel is optimized. Information about the customer rolls to be slit is obtained from a production control system for calculating/optimizing a machine reel diameter instruction for optimizing the diameter of the next machine reel, and the calculated/optimized machine reel diameter instruction is set in the control system of a reel-up.

20 Claims, 4 Drawing Sheets

U.S. PATENT DOCUMENTS

| | | | | |
|---|---|---|---|---|
| 4,901,577 | A | 2/1990 | Roberts | |
| 5,450,116 | A | 9/1995 | Weiselfish et al. | |
| 6,453,808 | B1 | 9/2002 | Nieminen et al. | |
| 6,520,080 | B1 | 2/2003 | Fried | |
| 6,873,879 | B2 * | 3/2005 | Bush et al. | 700/126 |
| 2004/0019401 | A1 * | 1/2004 | Bush et al. | 700/127 |

FOREIGN PATENT DOCUMENTS

| | | |
|---|---|---|
| WO | WO 2004/094282 | 11/2004 |

OTHER PUBLICATIONS

"Containerboard Mechanical Roll Quality Standards", Smurfit-Stone, Online! Jun. 1, 2001, XP002289965.

"Paper Machine Reel Optimization—Analysis and a Case Study" read by Dusan Dapcevic, published on pp. C37-C45 of the Conference Publication: Conference Record of the 1999 IEEE Annual Pulp & Paper Industry Technical Conference, Seattle, WA, Jun. 21-25, 1999; 1-10.

International Search Report issued in PCT/FI2004/000247.

Written Opinion of the International Searching Authority issued in PCT/FI2004/000247.

Search Report issued in FI20030618.

International Search Report issued in PCT/FI2004/000247, Sep. 3, 2004.

Written Opinion of the International Searching Authority issued in PCT/FI2004/000247, Sep. 3, 2004.

Search Report issued in FI20030618, Jan. 27, 2004.

* cited by examiner

METHOD FOR CALCULATING AND OPTIMIZING THE DIAMETER OF A PAPER OR BOARD WEB REEL BASED ON CUSTOMER SPLICE LOCATION RESTRICTIONS

CROSS REFERENCES TO RELATED APPLICATIONS

This application is a U.S. national stage application of International App. No. PCT/FI2004/000247, filed Apr. 22, 2004, the disclosure of which is incorporated herein, and claims priority on Finnish App. No. 20030618, Filed Apr. 24, 2003.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for calculating/optimizing the diameter of a paper or board web reel.

In paper and board machines a finished web is wound into machine reels which are sought to be run to a certain, usually a maximum, diameter so as to be as large as possible in size. These machine reels are run on a slitter-winder to form customer rolls, whose desired diameter and width are determined according to the customer's demand. In other words, rolls having a width and a diameter as desired by the customer are slit out of the full-width web of the machine reel by means of the slitter-winder. One problem in connection with the methods used in prior art is that if web breaks occur in the paper machine, the diameter of the machine reel changes.

In the prior art there is known a so-called continuous-trimming running mode in which machine reels are wound into a maximum diameter regardless of customer roll diameters except in the case of grade change. On the slitter-winder, splicing is accomplished to join machine reels to one another in order to obtain customer rolls of desired diameter size. Previously, splicing was performed manually and it was troublesome and difficult, the quality of splices varied and did not meet the requirements of printing houses. Today, there is also available an automatic splicing device, which has the advantage that the diameter of the machine reel need be optimized not according to individual sets but according to the entire order for a specific paper grade. However, it is problematic in this connection that, for reasons of the runnability of the printing press primarily with a view to minimizing breaks, it is required by the printing houses that if there are splices in customer rolls their number and location shall be as specified. In that connection, in the continuous-trimming running mode, it must be possible to calculate already in connection with the winding of the machine reel the location and the number of the splices caused by the joining of the ends of the webs of different machine reels to produce customer rolls of the right size so that the splices will be at the right location in the customer roll to be wound in order that it shall meet the criteria set by the customer and the amount of broke shall be minimized. The printing houses require, for example, that there shall be no splice at a given distance from the roll bottom or from the roll surface.

Previously, a manually calculated table was used concerning the effect of the customer roll diameter and the number of sets on the diameter of the machine reel. After that, automatic systems have been created to calculate the above-mentioned matters, in which it is additionally possible to take into account the effect of bad paper in the reel and different/varying winding tension as well as the thickness of paper both in the machine reel and in the customer roll and in which it is possible to take into account the content and size of machine reels placed in intermediate storage. This kind of procedure is described, for example, in the paper *Paper Machine Reel Optimization—Analysis and a Case Study* read by Dusan Dapcevic and published on pages C37-C45 of the conference publication: Conference Record of the 1999 IEEE Annual Pulp & Paper Industry Technical Conference; Seattle, Wash., Jun. 21-25, 1999; 1-10.

SUMMARY OF THE INVENTION

An object of the invention is to provide a method in which the drawbacks of the arrangements known from the prior art are eliminated or at least minimized and in which the above-noted objects are achieved.

In connection with the invention, the continuous-trimming running mode known per se is used as the running mode on the slitter-winder so that attempts are made to run machine reels of maximum size within the limits set by technology and economy, and the method in accordance with the invention determines/optimizes the machine reel diameter based on the printing houses' restrictions (*Roll Paper Requirements and Specifications*, Version 1.4, Jun. 16, 2000, Quebecor World Roll Paper Requirements and Specifications) or on converters' restrictions (*Smurfit-Stone, Containerboard Mechanical Roll Quality Standards,* 888-284-4470, Effective Date, Jun. 1, 2001) on the splice location in the customer roll. The diameter determined in the method in accordance with the invention is fed manually or automatically to the reel-up to control the reel-up.

In the method in accordance with the invention, the restrictions on the splice location are set as settable variables, for example, according to each individual paper grade or printing house/order. At the same time, the number of splices to be placed in customer rolls and the resultant machine reel broke, caused because of the joining of machine reels to one another, are optimized. The system in accordance with the invention also takes into account the undersize machine reels produced because of web breaks and the optimization of the location of the splice used for joining them.

The method in accordance with the invention provides, for example, a proposal for changing the slitting order of machine reels on the slitter-winder if the paper grade and the customer roll diameters allow it, whereby the splice can be placed in the customer roll at a location allowed by the printing house.

The application of the method in accordance with the invention can be a so-called stand-alone system, i.e. a separate system, or a part of the other production control system known per se.

The method in accordance with the invention makes it possible to improve material efficiency such that a maximum proportion of the paper produced on the paper machine can be wound into customer rolls in spite of the different restrictions concerning splices and roll diameters. In this way, material efficiency, i.e. the net efficiency achieved on the machine, is improved by means of the invention.

In the following, the invention will be described in greater detail with reference to the figures in the appended drawing, but the invention is not by any means meant to be narrowly limited to the details of them.

DESCRIPTION OF THE PREFERRED EMBODIMENTS

Figure 1:
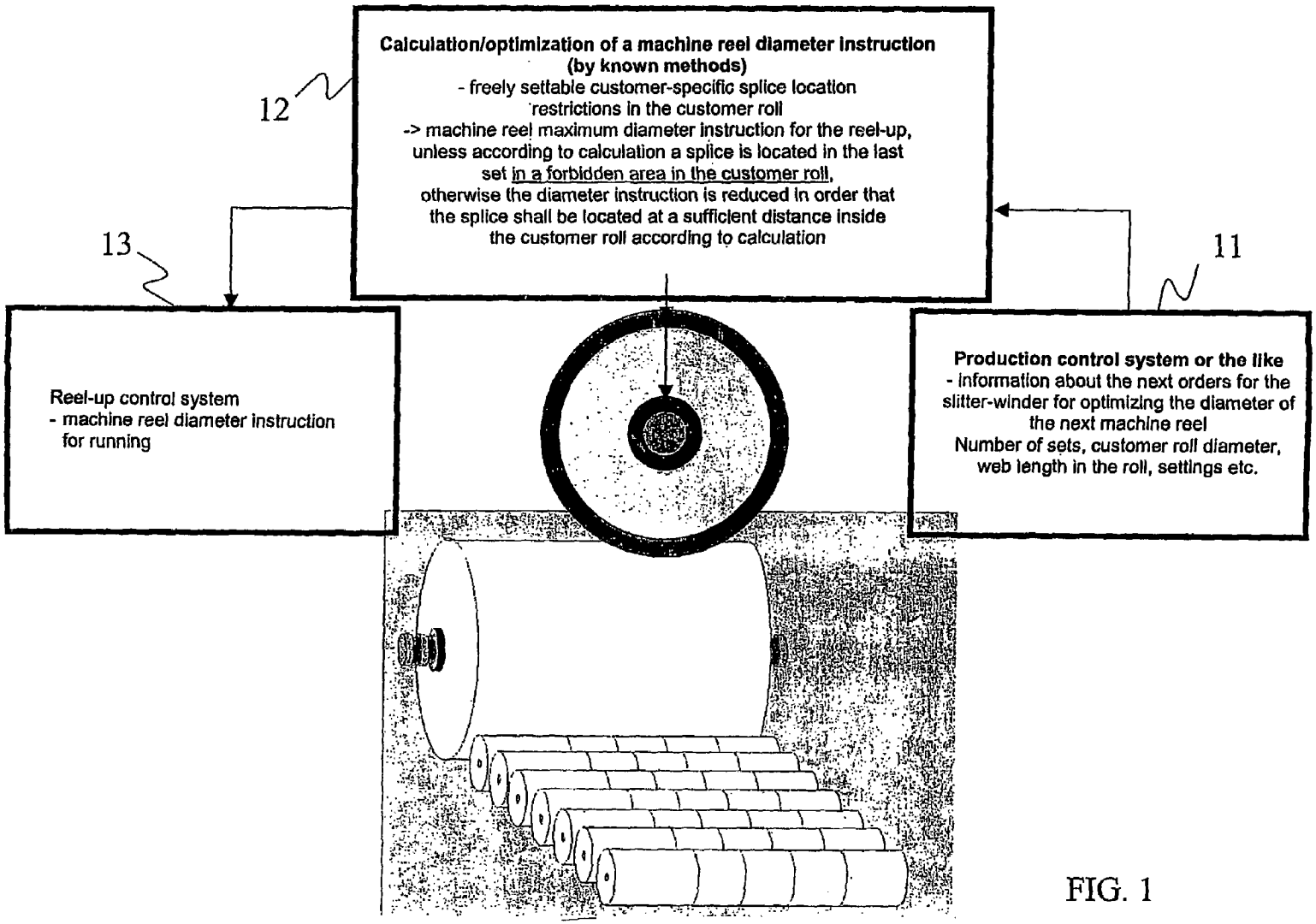
FIG. 1 schematically shows calculation/optimization of machine reel diameters.

As shown in FIG. 1, the information needed for calculation/optimization of machine reel diameters is obtained from a production control system 11, which provides, among other things, information about the next orders for the slitter-winder for the purpose of optimizing the diameter of the next machine reel, as well as the number of sets, customer roll diameters, web length in the roll, slitter-winder settings and other corresponding information. Based on this information, a diameter instruction 12 for the machine reel is calculated/optimized and freely settable splice location restrictions in the customer roll are obtained for a reel-up control system 13, thereby obtaining a maximum reel diameter instruction for the reel-up, unless according to calculation a splice is located in the last set in a forbidden area in the customer roll. If this is the case, the diameter instruction is reduced such that the splice will be located at a sufficient distance inside the customer roll according to calculation. In other words, the available information is used in the control system 13 of the reel-up, which gives a machine reel diameter instruction for running.

Figure 2:
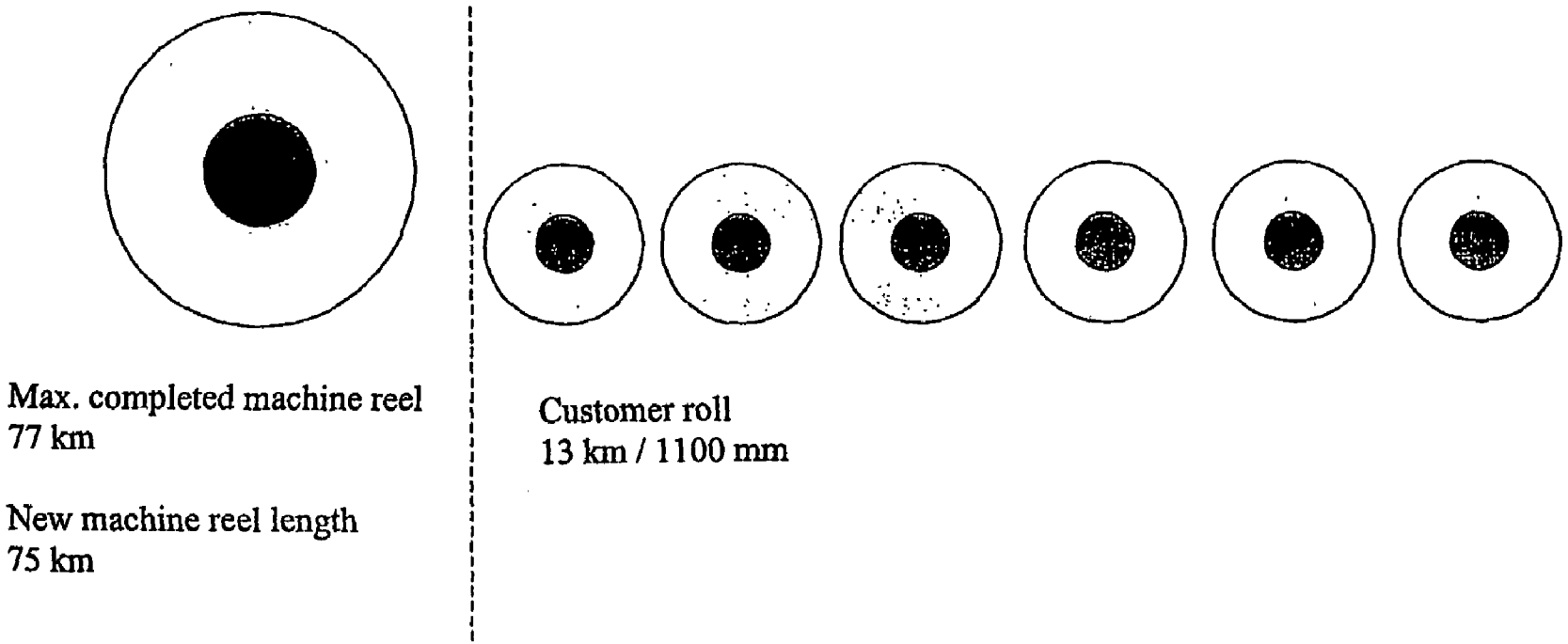
FIG. 2 schematically shows the effect of optimization of the location of the splice joining machine reels on broke length.

As shown in FIG. 2, the effect of optimization of the location of the splice joining machine reels on broke length is significant. In the example of FIG. 2, the maximum length in a completed machine reel is initially 77 km. The desired number of customer rolls is 6 and their web length is 13 km. The system finds that with the machine reel diameter that is being run a splice will be placed too close to the surface in the roll of the last set in view of the restrictions set by the customer. Consequently, the system reduces the length of the machine reel to 75 km, so that the splice will be at a sufficient distance from the surface of the roll, thus achieving a web saving of 2 km, i.e. 2.6% more material efficiency.

Figure 3:
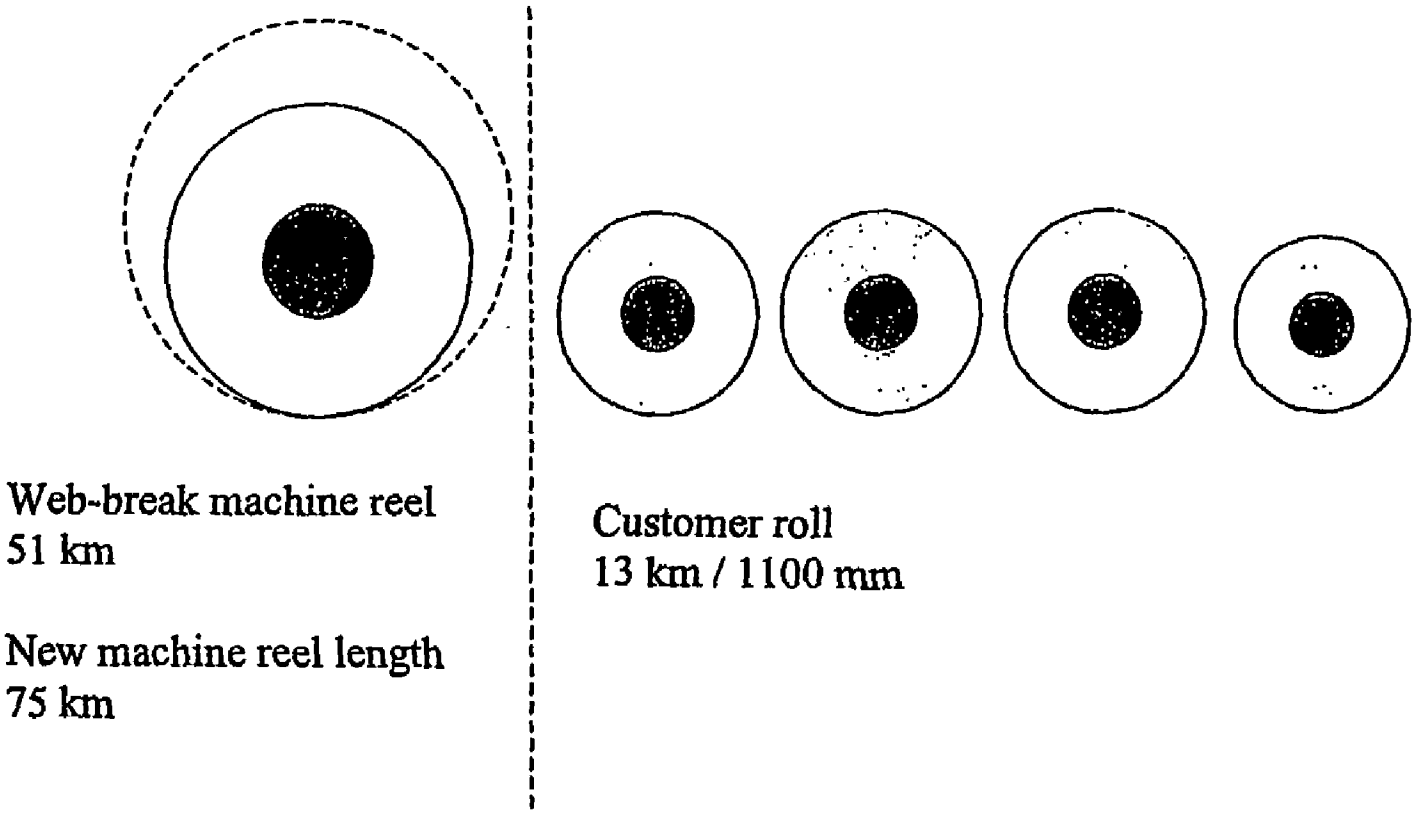
FIG. 3 schematically shows optimizing the location of the splice joining a web-break machine reel.

FIG. 3 shows optimization of the location of the splice joining a web-break machine reel. In the example shown in FIG. 3, the length of the web-break machine reel is 51 km. Four customer rolls of 13 km each are needed. The system finds that, as a result of a web break on the paper machine, the splice will be placed too close to the surface in the roll of the last set, with the result that the system gives an instruction to wind the next machine reel such that it will leave a bottom of 1.5 km for the last set, which means that the splice will be far enough from the bottom of the roll to which the preceding splice machine reel is joined, the running order of the machine reels at the slitter is changed. In this way, a 2.9% saving in the material of the machine reel is achieved with the new machine reel length of 75 km.

Figure 4:
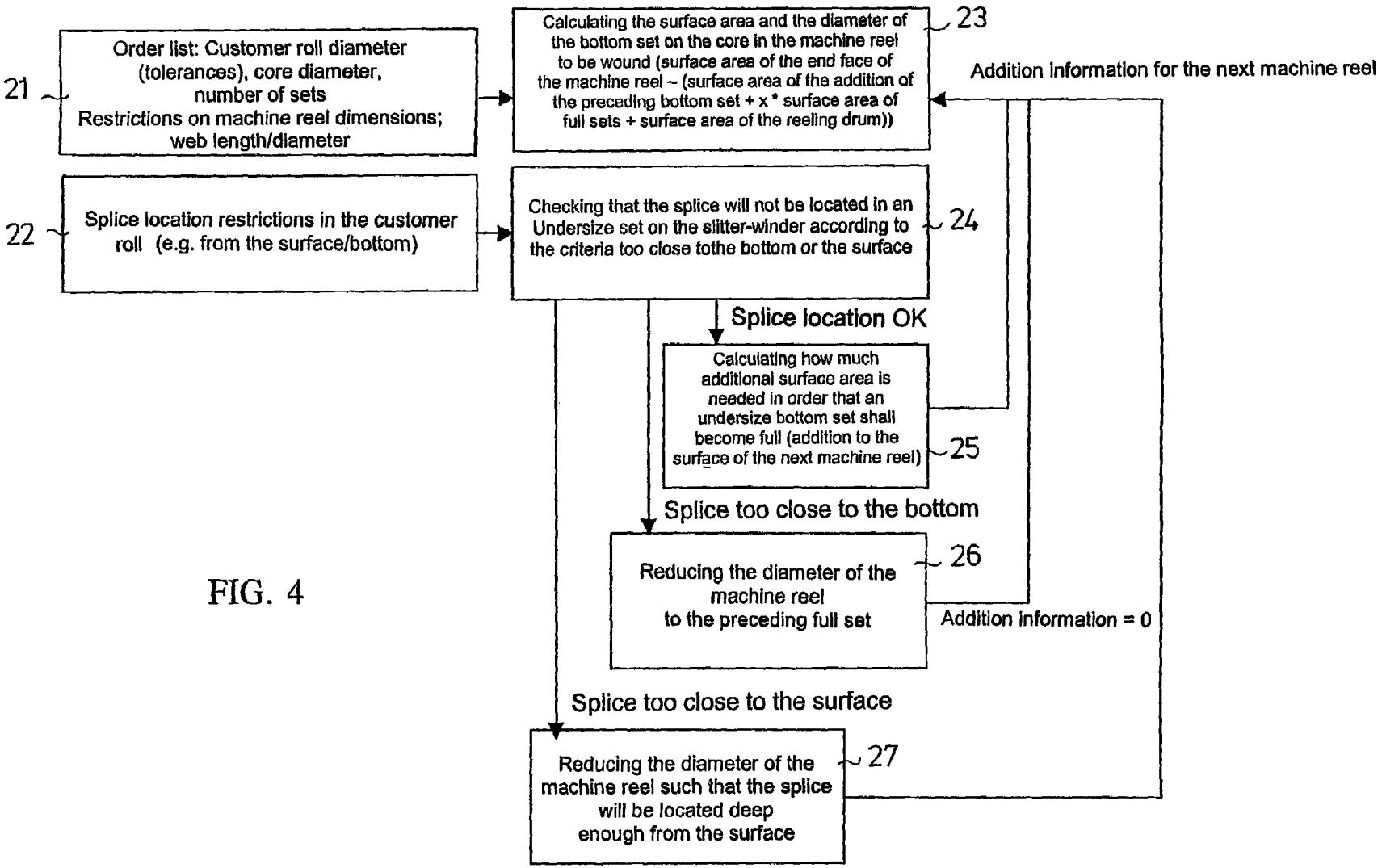
FIG. 4 is a schematic block diagram of calculation/optimization of machine reel diameters in a machine reel change/web-break situation.

In the block diagram shown in FIG. 4, the block 21 contains order list information; customer roll diameter (tolerances), core diameter, numbers of sets, and information about the restrictions on machine reel dimensions; web length/diameter. The necessary information about the restrictions on the location of a splice in the customer roll (e.g. from the surface/bottom) is given in the block 22. The block 23 receives information from the block 21 and addition information for the next machine reel, and the surface area of the bottom set of the machine reel to be wound and its diameter on the core are calculated by means of a method known per se in the block 23 (surface area of the machine reel−(surface area of the addition of the preceding bottom set+X*surface area of full sets+surface area of the reeling drum)). In the above calculation formula, by the surface area is meant the surface area of the end face of a cylinder or circle corresponding to a reel/roll and X=the maximum number of full sets obtained from the machine reel in question. In the block 24, the result received from the block 23 is compared with the information received from the block 22 concerning the restrictions on the splice location in the customer roll, if the splice location is OK, a transition is made to the block 25, where it is calculated how much additional surface area is needed in order that an undersize bottom set shall become full (addition to the surface of the next machine reel) and the information is transmitted further back to the block 23. If the splice is too close to the bottom, the machine reel diameter is reduced to the preceding full set according to the block 26 in order to receive addition information=0 as a result, and the information is transmitted further back to the block 23. If the splice is too close to the surface in the block 27, the machine reel diameter is reduced such that the splice will be placed deep enough from the surface. The information obtained from the block 27 is transmitted to the block 23. In accordance with the block diagram, in a machine reel change/web-break situation, the calculation/optimization of the machine reel diameter, in a reel change/web-break situation, the calculation/optimization of the machine reel diameter takes place such that the length (surface area of the end face) of the bottom set of the last completed machine reel (undersized) is stored in the memory of the system. The diameter of the bottom set of the next machine reel (undersized) is calculated, block 23, according to this value and the lengths (end-face surface areas) of the next sets in accordance with the order list, assuming that the reel will be one with a maximum diameter.

The calculated bottom set diameter is compared, block 24, with the splice location restrictions 22 (e.g. from the bottom and the surface of the customer roll) fed into the system.

The bottom splice restriction is found directly on the basis of diameter. If calculation shows that the splice will be placed too close to the bottom in a customer roll of an undersize surface set, block 26, the system reduces (when needed, the operator confirms the change) the target diameter of the machine reel which is building up such that an undersized bottom set is not wound into said machine reel.

The surface splice restriction is found by comparing the calculated diameter of the undersize bottom set with the diameter of the set in question according to the order list. If calculation shows that the splice will be placed too close to the surface in a customer roll of an undersize surface set, block 27, the system reduces (when needed, the operator confirms the change) the target diameter of the machine reel which is building up such that in the undersize surface set the splice will be placed at least at a distance according to the restriction from the surface.

If a web break occurs during the reeling of the machine reel, the system calculates the diameter of the undersize surface set of said machine reel, block 23, and checks the splice location restrictions, block 24. If the restriction is not violated, block 25, the system proceeds with the calculation of the next machine reel, as described above. If the restrictions are violated, the system proposes a change in the running order of machine reels or waste pulping.

Above, the invention has been described only with reference to some of its advantageous exemplifying embodiments, but the invention is not by any means intended to be narrowly limited to the details of them.

The invention claimed is:

1. A method for calculating and optimizing the diameter of a paper or board web machine reel, in which a web is wound in a paper or board machine into machine reels on a reel-up, which are run on a slitter-winder to form customer rolls, whose desired diameter and width are determined according to customer need, and in which a continuous-trimming running mode is used in which a desired amount of web is run into a machine reel and, when needed, splicing is performed on the slitter-winder to produce customer rolls with a desired diameter size, the method comprising the steps of:

determining the diameter of the machine reel to be wound on the paper or board machine on the basis of restrictions set by the customer on the location of a splice in the customer roll such that the amount of broke being produced from the machine reel is optimized, wherein information about the customer rolls to be slit is obtained from a production control system for calculating and optimizing a machine reel diameter instruction for the purpose of optimizing the diameter of the next machine reel, and calculated and optimized machine reel diameter instruction is set in a control system of the reel-up; and forming a machine reel on the paper or board machine according to the machine reel diameter instruction.

2. The method of claim 1 wherein calculated and optimized machine reel diameter instruction is fed manually to the control system of the reel-up.

3. The method of claim 1 wherein calculated and optimized machine reel diameter instruction is transmitted automatically to the control system of the reel-up.

4. The method of claim 1 wherein restrictions on the splice location are set according to each individual paper grade, printing house and/or order.

5. The method of claim 1 wherein number and location of splices to be placed in customer rolls and the resultant machine reel broke, caused because of the joining of machine reels to one another, are optimized.

6. The method of claim 1, wherein the step of determining the diameter of the machine reel to be wound further comprises accounting for undersize machine reels produced as a result of web breaks on the paper or board machine by calculating the diameter of the undersize surface set of said undersize machine reel, and checking the splice location restrictions, and if the restriction is not violated, proceeding with the calculation of the next machine reel, if the restrictions are violated, proposing a change in the running order of machine reels.

7. The method of claim 1 further comprising the step of changing slitting order of machine reels.

8. The method of claim 1, further comprising performing the steps within a stand-alone system in connection with a slitter-winder and a machine reel-up.

9. The method of claim 1, wherein the steps are performed within a production control system of the paper or board machine.

10. A method of forming customer rolls on a slitter-winder from machine reels formed on a paper or board machine having a reel-up, the method comprising the steps of:

winding a first machine reel of a paper or board web on the paper or board machine reel-up, the first machine reel being formed to have a first diameter;

winding a second machine reel of a paper or board web on the paper or board machine reel-up, the second machine reel being formed to have a second diameter; and running the first machine reel and the second machine reel on the slitter winder, and splicing the webs of the two machine reels together on the slitter winder, the spliced-together webs being run into a plurality of customer rolls, wherein the customer rolls are formed to have a desired diameter and width which are determined according to a customer's need, and wherein one of the first and second reel is wound to a machine reel diameter instruction, said machine reel diameter instruction being determined on the basis of restrictions set on the location of a splice in the customer roll, wherein information about the customer rolls to be slit is obtained from a production control system for determining the machine reel diameter instruction, and the machine reel diameter instruction is set in a control system of the reel-up.

11. The method of claim 10 further comprising the step of manually feeding the determined machine reel diameter instruction to the control system of the reel-up.

12. The method of claim 10 wherein the determined machine reel diameter instruction is transmitted automatically to the control system of the reel-up.

13. The method of claim 10 wherein the restrictions on the splice location are set according to each individual paper grade, printing house and/or order.

14. The method of claim 10 wherein one of the first machine reel and the second machine reel is an undersize machine reel produced as a result of a web break on the paper or board machine.

15. The method of claim 10 further comprising the step of changing the order of the first and second machine reels being run on the slitter winder.

16. The method of claim 10, wherein the method is applied as a stand-alone system in connection with a slitter-winder and a machine reel-up.

17. The method of claim 10, wherein the method is applied as a part of a production control system of the paper or board machine.

18. A method of forming customer rolls on a slitter-winder from machine reels formed on a paper or board machine having a reel-up, the method comprising the steps of:

winding a first machine reel of a paper or board web on the paper or board machine reel-up, the first machine reel being formed to have a first diameter;

winding a second machine reel of a paper or board web on the paper or board machine reel-up, the second machine reel being formed to have a second diameter; and running the first machine reel and the second machine reel on the slitter winder, and splicing the webs of the two machine reels together on the slitter winder, the spliced-together webs being run into a plurality of customer rolls, wherein the customer rolls are formed to have a desired diameter and width which are determined according to a customer's need, and wherein one of the first and second reel is wound to a machine reel diameter instruction, said machine reel diameter instruction being determined on the basis of restrictions set on the location of a splice in the customer roll, wherein information about the customer rolls to be slit is obtained from a production control system for determining the machine reel diameter instruction, and the machine reel diameter instruction is set in a control system of the reel-up;

wherein the step of determining a machine reel diameter instruction takes into account an order list including desired customer roll diameter, core diameter, number of sets to be run, restrictions on machine reel dimensions, and further comprises:

calculating the surface area and diameter of a bottom set; and checking that the splice formed by joining a machine reel of a diameter determined by the machine reel diameter instruction and another machine reel, based upon set splice location restrictions, will not be too close to the bottom or the surface of the customer roll; and wherein if the splice location is acceptable the machine reel diameter instruction does not change; and wherein if the splice location is too close to the bottom the machine reel diameter instruction is reduced such that the splice location is acceptable; and wherein if the splice location is too close to the surface the machine reel diameter instruction is reduced such that the splice location is acceptable.

19. A process for forming machine reels and converting them to smaller diameter customer rolls comprising the steps of:

forming a plurality of machine reels, each machine real having an area less than or equal to a selected maximum machine reel area;

wherein an acceptable roll area range is range of roll areas such that a splice between the customer roll of the acceptable roll area and subsequent paper to bring said customer roll to said smaller diameter will not be located too close according to customer criteria to a bottom or a surface of the formed customer roll;

determining the desired final area of a presently being formed machine reel by determining how much of the presently being formed reel will be partially wound into a customer roll which is formed, in part, of a previously formed machine reel;

determining a remainder reel area which is the selected maximum machine reel area, less the area of as many complete customer rolls as possible to be formed, and if the remainder reel area will form a customer roll within the acceptable roll area range, then continuing to wind the presently being formed machine reel to the maximum machine reel area;

if the remainder reel area is below the acceptable roll area range, then decreasing the area of the presently being formed machine reel so that the remainder reel area is zero; and if the remainder reel area is above the acceptable roll area range, then decreasing the presently being formed machine reel area so that the remainder reel area falls within the acceptable roll area range.

20. A process for forming machine reels and converting them to smaller diameter customer rolls comprising the steps of:

forming a plurality of machine reels, each machine reel having an area which is less than or equal to a selected maximum machine reel area;

forming a machine reel as a result of a paper break of a selected area less than the selected maximum machine reel area;

determining the desired final area of a presently being formed machine reel by determining how much of the present reel will be wound into a customer roll which is formed in part of a previously formed machine reel formed before the machine reel as a result of a paper break, determining a remainder reel area as the selected maximum machine reel area less the area of as many complete customer rolls as possible, and determining if the remainder reel area will form a customer roll of an area within a selected range based on splice location restrictions set by the customer, and if the remainder reel area is below the selected range, decreasing the diameter of the present machine reel so that the remainder reel area is zero, and if the remainder reel area is above the selected range, decreasing the present machine reel area so that the remainder reel area falls within the selected range, and further selecting the area of the presently being formed machine reel so that the machine reel formed as a result of a paper break when formed into customer rolls after the presently being formed machine reel, will also form a last customer roll of an area within the selected range.

* * * * *